US007177555B2

(12) United States Patent
Shu et al.

(10) Patent No.: US 7,177,555 B2
(45) Date of Patent: Feb. 13, 2007

(54) IMAGE FORMING PROCESS AND IMAGE FORMING APPARATUS

(75) Inventors: Bing Shu, Shizuoka (JP); Mitsuo Aoki, Shizuoka (JP); Haruji Mizuishi, Tokyo (JP); Mikio Ishibashi, Kanagawa (JP); Masaru Tanaka, Kanagawa (JP); Shinji Tamaki, Tokyo (JP); Hiroshi Mizusawa, Tokyo (JP); Shin Hasegawa, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 62 days.

(21) Appl. No.: 10/757,526

(22) Filed: Jan. 15, 2004

(65) Prior Publication Data

US 2004/0146309 A1 Jul. 29, 2004

(30) Foreign Application Priority Data

Jan. 15, 2003 (JP) ..... 2003-006671
Feb. 7, 2003 (JP) ..... 2003-030487

(51) Int. Cl.
*G03G 15/08* (2006.01)

(52) U.S. Cl. ..... 399/27; 399/53

(58) Field of Classification Search ..... 399/27, 399/53

See application file for complete search history.

(56) References Cited

U.S. PATENT DOCUMENTS 5,912,100 A * 6/1999 Aoki et al. ..... 430/108.7
6,148,161 A 11/2000 Usui et al.
6,198,895 B1 3/2001 Tsuda et al.
6,256,459 B1 7/2001 Hasegawa et al.
6,266,501 B1 7/2001 Mizuishi et al.
6,337,957 B1 1/2002 Tamaki et al.
6,403,275 B1 6/2002 Kuramoto et al.

(Continued)

FOREIGN PATENT DOCUMENTS

JP 63214785 A * 9/1988

(Continued)

OTHER PUBLICATIONS

U.S. Appl. No. 11/223,998, filed on Sep. 13, 2005, Shu et al.

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

The image forming apparatus comprises a photoconductor, a latent electrostatic image forming unit for forming a latent electrostatic image on the photoconductor, a developing unit for developing the latent electrostatic image using a developer comprising a toner to form a visible image, a transfer unit for transferring the visible image to a recording medium, a cleaning unit for removing the developer remained on the photoconductor surface and a developer amount detection unit for detecting developer amount adhering to the photoconductor surface by a reflecting photosensor, wherein the developer stirring time per copy when one copy is made from an original, is 2 to 6 times the developer stirring time per copy when two or more copies are made from the original, wherein the toner comprises at least a binder resin and a wax, and the dynamic frictional coefficient of the toner is 0.15 to 0.45.

34 Claims, 4 Drawing Sheets

U.S. PATENT DOCUMENTS

| | | | |
|---|---|---|---|
| 6,522,855 | B1 | 2/2003 | Katoh et al. |
| 6,553,202 | B2 | 4/2003 | Tamaki et al. |
| 6,593,048 | B2 | 7/2003 | Sasaki et al. |
| 6,667,141 | B2 | 12/2003 | Iwamoto et al. |
| 6,699,632 | B2 | 3/2004 | Higuchi et al. |
| 2003/0180057 | A1 | 9/2003 | Sawada et al. |

FOREIGN PATENT DOCUMENTS

| | | | | |
|---|---|---|---|---|
| JP | 02287460 | A | * | 11/1990 |
| JP | 06019297 | A | * | 1/1994 |
| JP | 6-82226 | B | | 10/1994 |
| JP | 8-3656 | B | | 1/1996 |
| JP | 11-95477 | | | 4/1999 |
| JP | 11095477 | A | * | 4/1999 |
| JP | 2000250245 | A | * | 9/2000 |
| JP | 2001312090 | A | * | 11/2001 |
| JP | 2002365832 | A | * | 12/2002 |
| JP | 2002365847 | A | * | 12/2002 |

OTHER PUBLICATIONS

U.S. Appl. No. 11/227,178, filed on Sep. 16, 2005, Hasegawa et al.
U.S. Appl. No. 11/408,031, filed on Apr. 21, 2006, Shu et al.

* cited by examiner

IMAGE FORMING PROCESS AND IMAGE FORMING APPARATUS

BACKGROUND OF THE INVENTION

1. Field of the Invention

The present invention relates to an image forming apparatus and image forming process suitable for a copier, printer or facsimile machine.

2. Description of the Related Art

In the related art, in an image forming process comprising a step wherein a latent electrostatic image formed on a photoconductor was developed by a developer comprising a toner, a developed toner image was transferred to a transfer medium such as paper or the like, and the photoconductor was cleaned to prepare it for the next image forming operation, many proposals were made to improve image quality, make the image forming apparatus more compact, save energy, speed up the process and reduce costs.

For example, Japanese Patent Application Laid-Open (JP-A) No. 09-244292 proposes a method wherein, by coating a polyurethane wax surface adhering to toner particles with additive microparticles so that the surface is suitably exposed, the opportunities for direct contact between the wax and the photoconductor surface are reduced. According to this proposal, photoconductor filming due to the wax is suppressed, it is easy to make the apparatus more compact, reduce costs and simplify the process, and a toner is obtained without filming due to wax or additive separation and without loss of fluid properties due to crushing of the toner.

In Japanese Patent Application Publication (JP-B) No. 3000401, to improve cleaning properties of the photoconductor surface in the operations after developing, fatty acid removal type carnauba wax and/or dimethyl silicone oil having a dynamic viscosity factor of 30 centipoises to 60,000 centipoises and a molecular weight of 2,000 or less is supplied as a material to reduce the frictional coefficient of the photoconductor surface.

In JP-B No. 2675974, to make the unevenness of the toner particle surface and hardness of the toner particles suitable, magnetic toner particles containing 1% to 10% of a polyalkylene resin having a weight average molecular weight of 3,000 to 80,000 relative to toner resin, and a silica microparticle additive, these magnetic particles having a dynamic frictional coefficient in a range between 0.20 which is sufficient to polish the photoconductor surface and 0.50 which does not scratch the photoconductor surface, are described.

In JP-B No. 08-3656, a toner comprising a magnetic toner A and a colorless toner B, wherein the toner B has a dynamic frictional coefficient in a range between 0.20 which is sufficient to polish the photoconductor surface and 0.60 which does not scratch the photoconductor surface, the dynamic frictional coefficient of toner A being less than that of toner B, is described.

In JP-B No. 06-82226, a latent electrostatic image formed on a OPC photoconductor having a surface hardness of 10 g to 100 g is developed to form a toner image using a toner containing polyalkylene microparticles and hydrophobically-treated silica having an average particle diameter of 3.0 μm or less, the toner having a dynamic frictional coefficient of 0.15 to 0.65, and cleaning is performed.

In JP-A No. 11-95477, a toner comprising toner particles containing a binder resin, colorant, vegetable wax of melting point 66° C. to 86° C. and/or polyethylene wax of melting point 80° C. to 140° C., and an additive, the dynamic frictional coefficient of the toner being 0.12 to 0.30, is described.

In JP-A No. 2000-105484, a toner containing a three-dimensional cross-linked polyester resin binder whereof the static frictional coefficient is reduced to 0.4 or less by a wax, and is suitable for flash fusing fixing, is described.

In JP-A No. 2001-5220, a color toner wherein the difference between the maximum dynamic frictional coefficient and minimum dynamic frictional coefficient of 4 colored toners is adjusted to 0.2 or less, is described.

In recent years, due to limited office space, there has been a demand to make copiers and composite devices more compact, and also to make the units comprising these devices more compact.

Small photoconductor drums installed in actual machines have an outer diameter of 20 mm to 30 mm, but in general, as it is required to perform charging, exposure, developing, transferred, cleaning and discharging steps, it is necessary to install units to provide these functions around the photoconductor of an image forming apparatus using the electrophotographic method. However, in the present technology, there is a limit to the compactness of the units surrounding the photoconductor. In addition to the various units mentioned above, it is also required to install separating claw and reflecting photosensors (hereafter, "P sensors") to control image density.

The P sensor detects the toner amount adhering to the photoconductor surface, and feeds this back to toner supplementation amount control. When controlling image density on a transfer paper, as the toner amount can be detected closer to the final step of the electrophotographic process, it is therefore an effective means of achieving stable image density.

When this P sensor detects the toner image developed on the photoconductor surface, the detection must be performed between the developing step and cleaning step which are performed around the photoconductor. In other words, the aforesaid P sensor must be installed in the vicinity of the transfer step, and it must be installed without obstructing the transfer paper transport path.

One means of installing the P sensor within these limitations is for example a remote P sensor. This remote P sensor is separated from the photoconductor surface, the detection target, by approximately 20 mm, and is therefore installed further away from the photoconductor than the 3 mm to 5 mm of the prior art near type. This has a major advantage in that, provided the P sensor has a sufficient light path for emitting and receiving light, as it is not necessary to install the P sensor in the vicinity of the photoconductor, the limited space of the image forming apparatus in which the small diameter photoconducting drum is installed can be effectively utilized.

The control of the P sensor will now be described.

First, the light emission amount is varied so that the sensor output (Vsg) is 4.0V compared to the background part of the photoconductor to which toner is not adhering. In practice, to adjust the light emission amount of the P sensor installed in the image forming apparatus, the current flowing through the P sensor light-emitting element is controlled by PWM, and this PWM value is automatically varied so that Vsg adjustment is terminated when Vsg=4.0V. Subsequently, it is fixed at the adjusted PWM value on the next occasion Vsg adjustment is performed.

Vsg adjustment is performed for example when the main switch on the image forming apparatus is switched ON, when the apparatus is recovering from the pre-heating mode, and when a copy operation is terminated after a preset number of copies have passed through the machine.

In general, the toner adhesion amount on the photoconductor is detected by the P sensor after every 100 copies have been made, and the toner supplementation amount is determined by an output ratio (Vsp/Vsg) of the output (Vsp) when a toner adhesion pattern for the P sensor is detected, and the background part detection output (Vsg).

As the light source of an economical P sensor, a phototransistor or photodiode may be used, but unlike laser light, the light from this diverges to some extent. Therefore, although normally-reflected light is mainly received, some diffuse reflected light is also received.

However, in this image forming apparatus using an electrophotographic method, the photoconductor is in contact with a large number of components such as a developer, developer inlet seal to prevent toner scatter, cleaning blade, cleaning fur brush, cleaning inlet seal, separating claw, discharge roller and transfer roller, and there is constant friction with these components during the copying process. As a result, when the copy operation is performed repeatedly, the photoconductor surface gradually wears down.

Of those members in contact with the photoconductor, the cleaning blade is in contact with the photoconductor under a constant pressure due to its function of eliminating toner adhering to the photoconductor surface, so it makes a large contribution to the wear of the photoconductor surface. In this regard, it has been proposed to use a toner containing a wax which reduces the frictional coefficient of the photoconductor (JP-A No. 09-244292), or to supply a wax or silicone oil to the photoconductor surface (JP-B No. 3000401).

If the wax amount which leaks from the toner on the cleaning blade is uneven, some parts of the photoconductor will have high wear and others will have low wear, and the photoconductor will wear unevenly as described above.

Also, to prevent streaks due to interposition of foreign material, an image forming apparatus has been proposed wherein a cleaning blade is vibrated in the photoconductor axis direction. In this image forming apparatus, local wear is prevented due to the vibrating mechanism and the photoconductor wears more evenly, but it is difficult to install in an image forming apparatus where low-cost and small space are desired.

If such a photoconductor with uneven wear is used, an uneven density image with vertical striations may be obtained in the case of halftone images, etc.

This is because the distant P sensor receives a greater proportion of normally-reflected light than a near sensor, and the attenuation factor of the received light relative to the emitted light is also high. Therefore, if a Vsg adjustment of the P sensor is made using a photoconductor of uneven wear, the normally-reflected light remarkably decreases compared to a photoconductor which has no wear or a photoconductor which has even wear, so the emitted light amount from the P sensor, i.e., the PWM value, must be largely increased. If the large increment of this PWM value exceeds the limit, the Vsg adjustment of the P sensor will be unsatisfactory.

The aforesaid defect is due to uneven wear of the photoconductor surface over time, and is affected by the wax which has leaked from the toner.

The wax added to the toner melts in the step which fixes the toner image on the transfer paper transferred in the transfer step, and has the effect of helping it to separate from the fixing roller so that an offset image is not produced. Hence, the offset tolerance during fixing increases the larger is the wax amount in the toner, but on the other hand, as the wax amount which gradually flows out onto the toner surface due to hazards such as heat or pressure imparted to the toner in the developer or cleaning part increases, the more is the addition amount in the toner, the more is the uneven wear of the photoconductor surface.

The wax which leaked onto the toner surface is spent on the carrier surface, and due to the deterioration of charge, toner adheres to the non-image part of the photoconductor causing background soiling.

Further, toner microparticles where wax has leaked onto the surface are not easily transferred, are scraped by the cleaning blade, and return again to the developer part via a recycle path which makes image deterioration even worse.

The wax smears on the toner surface depend on the wax amount, and are also largely affected by the wax dispersion diameter in the toner.

For example, if toner is subjected to pressure due to a physical force such as by stirring the developing part, due to the hazard resulting from the heat or pressure produced at that time, wax leaks onto the toner surface so as to cause "bleed out". This phenomenon tends to occur more easily, the larger is the wax dispersion diameter.

Further, the wax smears on the toner surface are affected by the wax addition amount to the toner, and are also largely affected over time by the process conditions of the copy machine. For example, when the developer part is stirred, the proportion of wax leaking onto the toner surface due to the physical stress of pressure and heat increases. If this wax smear amount is unevenly distributed, some parts of the photoconductor will have a high frictional coefficient and some parts will have a low frictional coefficient, so the photoconductor will have uneven wear, and an image of uneven density with vertical striations may appear in the case of halftone images, etc.

Users of low speed machines having a system line speed of 100 mm/sec to 200 mm/sec frequently output only one copy or print, and the developer stirring time during developing becomes larger compared to the number of copies and prints.

It is known that in general, when the rotation (stirring) time of the developer is longer in terms of unit copies, stress such as heat or pressure acting on the developer increases. In other words, in the case of a mode where one copy is made from one original, 2 to 6 times the rotation time is required compared to the developer time per sheet when continuous copies are made, and therefore a very large heat stress acts on the developer. This phenomenon is particularly frequent in the case of users of low speed machines having a system speed of 100 mm/sec to 200 mm/sec.

For example, in the case of a machine which can produce 27 copies per minute, for continuous copies, approximately 3 seconds is required per sheet. However, for making one copy, the developer unit rotates for approximately 7.5 seconds. The reason for this is that even if the motor is running, transfer paper is prepared and developing is completed after the switch is switched ON, due to the transfer, fixing and paper ejection steps, a long time is required. This could be dealt with by stopping the operation of the developing part immediately after developing is finished, but if the photoconductor is rotating, carrier adhesion takes place which is a problem. In view of the time for which the P sensor functions in terms of unit copies, 2 to 6 times the developing rotation time is presently required. As a result, the heat and pressure stress acting on the developer increases as described above, and this shortens the life of the developer.

Object and Advantages

It is a first object of the present invention to provide an image forming process and image forming apparatus wherein, in an image forming apparatus designed for low-cost and small space, to suppress uneven wear of a photoconductor over time, a developer having an appropriate toner dynamic frictional coefficient which is affected by surface wax is combined with the most suitable processes to eliminate uneven wear due to abrasion of the photoconductor, background soiling and unevenly dense images with vertical striations, such as in the case of halftone images or the like.

It is a second object of the present invention to provide an image forming process and image forming apparatus wherein, in an image forming apparatus designed for low-cost and small space, to suppress uneven wear of a photoconductor over time, a developer having an appropriate wax dispersion diameter in a toner which is affected by surface wax is combined to eliminate uneven wear due to abrasion of the photoconductor, background soiling and unevenly dense images with vertical striations, such as in the case of halftone images or the like.

SUMMARY OF THE INVENTION

The image forming apparatus of the present invention contains a photoconductor, a latent electrostatic image forming unit which forms a latent electrostatic image on this photoconductor, a developing unit which develops the latent electrostatic image to form a visible image by using a developer comprising a toner, a developer amount detection unit which detects the developer amount adhering to the photoconductor surface by a reflecting photosensor, a transfer unit which transfers this visible image to a recording medium, and a cleaning unit which removes the developer on the photoconductor surface, wherein the developer stirring time per copy when one copy is made from one original is 2 to 6 times the developer stirring time per copy when two or more copies are made from one original, the toner contains at least a binder resin and a wax, and the dynamic frictional coefficient of the toner is 0.15 to 0.45. As a result, uneven wear due to abrasion, background soiling and unevenly dense images with vertical striations such as in the case of halftone images or the like, are eliminated.

The image forming process of the present invention contains image forming step which forms a latent electrostatic image on a photoconductor, a developing step which develops the latent electrostatic image to form a visible image by using a developer containing a toner, a developer amount detecting step which detects the developer amount adhering to the photoconductor surface by a reflecting photosensor, a transfer step which transfers this visible image to a recording medium, and a cleaning step which removes developer on the photoconductor surface, wherein the developer stirring time per copy when one copy is made from one original is 2 to 6 times the developer stirring time per copy when two or more copies are made from one original, the toner contains at least a binder resin and a wax, and the dynamic frictional coefficient of the toner is 0.15 to 0.45. As a result, uneven wear due to abrasion, background soiling and unevenly dense images with vertical striations such as in the case of halftone images or the like, are eliminated.

Figure 1:
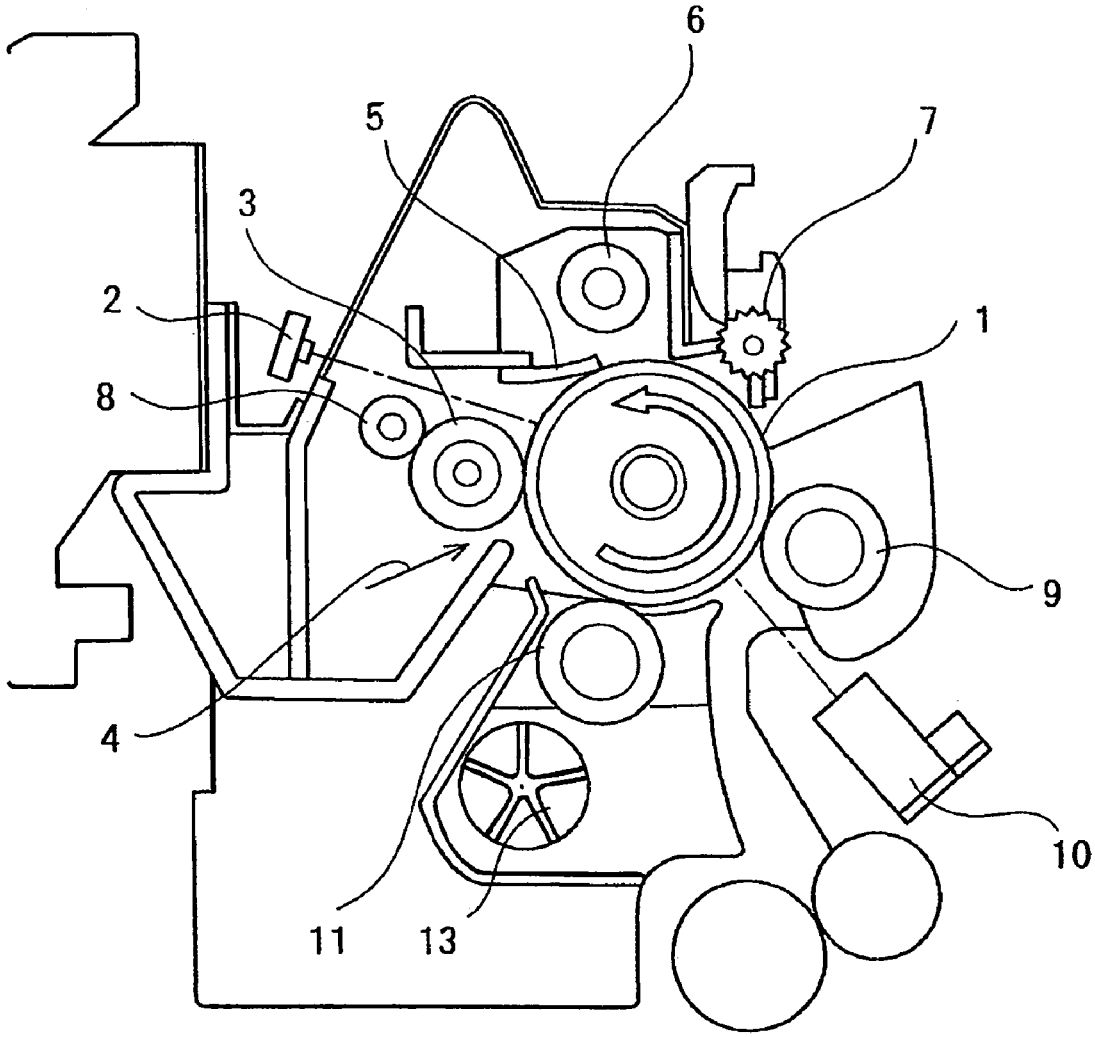
FIG. 1 is a diagram showing an example of the layout of an image forming apparatus using the image forming process of the present invention.

DESCRIPTION OF THE PREFERRED EMBODIMENTS (Image Forming Apparatus and Image Forming Process)

The image forming apparatus of the present invention comprises at least a photoconductor, latent image forming unit, developing unit, cleaning unit and developer amount detection unit, and may also comprise other suitably selected unit if required, for example a supplementary amount control unit, recycle unit, fixing unit, discharge unit and control unit.

The image forming process of the present invention comprises at least a latent electrostatic image forming step, developing step, transfer step, cleaning step and developer amount detection step, and may also comprise other suitably selected steps if required, for example a supplementary amount control step, recital step, fixing step, discharge step and control step.

The image forming process of the present invention can be suitably applied to the image forming apparatus of the present invention. The latent electrostatic image forming step can be performed by the latent electrostatic image forming unit, the developing step can be performed by the developing unit, the transfer step can be performed by the transfer unit, and the fixing step can be performed by the fixing unit. The other steps can be performed by the aforesaid other unit.

-Latent Electrostatic Image Forming Step and Latent Electrostatic Image Forming Unit- The latent electrostatic image forming step is a step for forming a latent electrostatic image on a photoconductor.

The photoconductor (hereafter, may be referred to as a "photoconducting insulator" or "latent electrostatic image carrier") is not particularly limited as regards material, shape or construction, and may be suitably selected from among those known in the art, but its shape may be that of a drum, and its material may be that of an inorganic photoconductor, such as amorphous silicon or selenium, or an organic photoconductor such as polysilane or phthalopolymethane. Of these, organic photoconductor is preferred.

The photoconductor preferably comprises a photoconducting layer comprising an organic photo-semiconductor on a surface. Depending on the selection of materials of the organic photo-semiconductor, the photoconductor may be negatively charged or positively charged. Specifically, in the case of a negatively charged photoconductor, an electron donor compound is selected for the organic photo-semiconductor, whereas for a positively charged photoconductor, an electron acceptor compound is selected.

Examples of high molecular weight compounds used as the electron donor compound are poly-N-vinylcarbazole, polyvinylprene, polyvinylanthracene and pyrene-formaldehyde condensate. Examples of low molecular weight compounds are oxadiazole, oxazole, pyrrazoline, triphenylmethane, hydrazone, trianilamine, N-phenylcarbazole and stilbene. The low molecular weight compounds may be dispersed for example in a binder such as polycarbonate, polyester, methacrylic resin, polyamide, acryl epoxy, polyethylene, phenol, polyurethane, butyral resin, polyacetate vinyl and urea resin. A typical example is a dispersion of the hydrazone compound THQH (1-phenyl-1,2,3,4,-tetrahydroquinoline-6-carboxyaldehyde-1'1'-diphenylhydrazone) or DEH (4-diethylamino-benzaldehyde-diphenylhydrazone) in a polymer resin such as a polycarbonate or the like.

An example of an electron acceptor compound is chloranil, bromanil, tetracyanoethylene, tetracyanoquinodimethane, 2,4,7-trinitro-9-fluorenone, 2,4,5,7-tetra nitroxanthone, 2,4,8-trinitro thioxanthone, 2,6,8-trinitro-4H-indeno [1,2-b]thiophene-4on, 1,3,7-trinitrodibenzothiophene-5,5-dioxide, 2,4,7-trinitrofluorenone.

During the copying process, there is friction between the photoconductor and parts such as a developing sleeve, and this may cause local scratches due to physical stress. It is desirable that the surface height of the protrusions in the unevenness of the scratches is levelled by abrasion with a cleaning blade.

The outer diameter of the photoconductor is preferably 20 mm to 40 mm. The surface frictional coefficient of the photoconductor is preferably 0.3 to 0.7. If the surface frictional coefficient of the photoconductor is less than 0.3, abrasion with the cleaning blade is difficult and unevenness remains, whereas if the surface frictional coefficient is more than 0.7, the photoconductor is abraded too much by the cleaning blade which shortens its life.

The latent electrostatic image can be formed for example by uniformly charging the surface of the aforesaid photoconductor, and exposing it imagewise, which may be performed by the aforesaid latent electrostatic image forming unit.

The latent electrostatic image forming unit for example comprises at least a charging device which uniformly charges the surface of the photoconductor, and an exposure device which exposes the surface of the photoconductor imagewise.

The charging may for example be performed by applying a voltage to the surface of the photoconductor using the aforesaid charging device.

The charging device is not particularly limited and may be suitably selected according to the purpose, examples being contact chargers known in the art such as a conductive or semi-conductive roller, brush, film or rubber blade, and non-contact chargers using corona discharge such as a corotron or scorotron.

The exposure can be performed by exposing the surface of the photoconductor imagewise, for example using the aforesaid exposure device.

The exposure device is not particularly limited and may be suitably selected according to the purpose provided that it can expose the surface of the photoconductor charged by the aforesaid charger in the same way as the image to be formed, for example an exposure device such as a copy optical system, a rod lens array system, a laser optical system or a liquid crystal shutter optical system.

In addition, in the present invention, a backlight system may be employed wherein the aforesaid photoconductor is exposed imagewise from its rear surface.

-Developing Step and Developing Unit-

The developing step is a step which develops the aforesaid latent electrostatic image using the toner or the developer of the present invention to form a visible image.

The visible image can be formed for example by developing the latent electrostatic image using the toner or the developer of the present invention, which can be performed by the developing unit.

The developing unit is not particularly limited provided that it can develop an image for example by using the toner or the developer of the present invention, and may be suitably selected from among those known in the art. Examples are those which comprise at least a developing unit housing the toner or developer of the present invention, and which can supply the toner or developer with contact or without contact to the aforesaid latent electrostatic image.

The developing unit may be for a dry developing or wet developing, and may be a monochrome developing unit or a multi-color developing unit. Examples are units comprising a stirrer which charge the toner or the developer by friction stirring, and units comprising a rotatable magnet roller. A stirring roller 13 is illustrated in FIG. 1 as part of the developing unit.

In the aforesaid developing unit, the toner and the carrier may for example be mixed and stirred together. The toner is thereby charged by friction, and forms a magnetic brush on the surface of the rotating magnet roller. As this magnet roller is arranged near the photoconductor, part of the toner in the magnetic brush formed on the surface of this magnet roller moves to the surface of this photoconductor due to the force of electrical attraction. As a result, the aforesaid latent electrostatic image is developed by this toner, and a visible toner image is formed on the surface of this photoconductor.

The developer housed in the developing unit is a developer containing the aforesaid toner of the present invention, and the developer may be a one-component developer or a two-component developer.

-Transfer Step and Transfer Unit-

The transfer step is a step which transfers the visible image to a recording medium. The aforesaid transfer can be realized for example by charging the aforesaid photoconductor using a transfer charger, which can be performed by the aforesaid transfer unit.

The aforesaid transfer unit preferably comprises at least a transfer unit which charges by releasing the visible image formed on the aforesaid photoconductor to the recording-medium side. There may be one, two or more of the aforesaid transfer unit.

The transfer unit may be a corona transfer unit which functions by corona discharge, a transfer belt, a transfer roller, a pressure transfer roller or an adhesion transfer unit.

The aforesaid recording medium is not particularly limited and may be suitably selected from among recording media (recording papers) known in the art.

The aforesaid fixing step is a step which fixes the visible image transferred to the recording medium using a fixing apparatus. This may be carried out for toner of each color transferred to the recording medium, or in one operation when the toners of each color have been laminated.

The fixing apparatus is not particularly limited and may be suitably selected from heat and pressure unit known in the art. Examples of heat and pressure unit are a combination of a heat roller and pressure roller, and a combination of a heat roller, pressure roller and endless belt.

The heating by the aforesaid heat and pressure unit is preferably heating to 80° C. to 200° C.

The aforesaid discharge step is a step which applies a discharge bias to the aforesaid latent electrostatic image carrier to discharge it, which may be performed by a discharge unit.

The aforesaid discharge unit is not particularly limited and may be suitably selected from discharge unit known in the art provided that it can apply a discharge bias to the aforesaid photoconductor, for example, a discharge lamp.

The aforesaid cleaning step is a step which removes toner remaining on the photoconductor, and may be performed by a cleaning unit.

The aforesaid cleaning unit is not particularly limited, but stress is placed on low-cost and space-saving, so it must satisfy its cleaning function by unit of a very simple construction.

Figure 3:
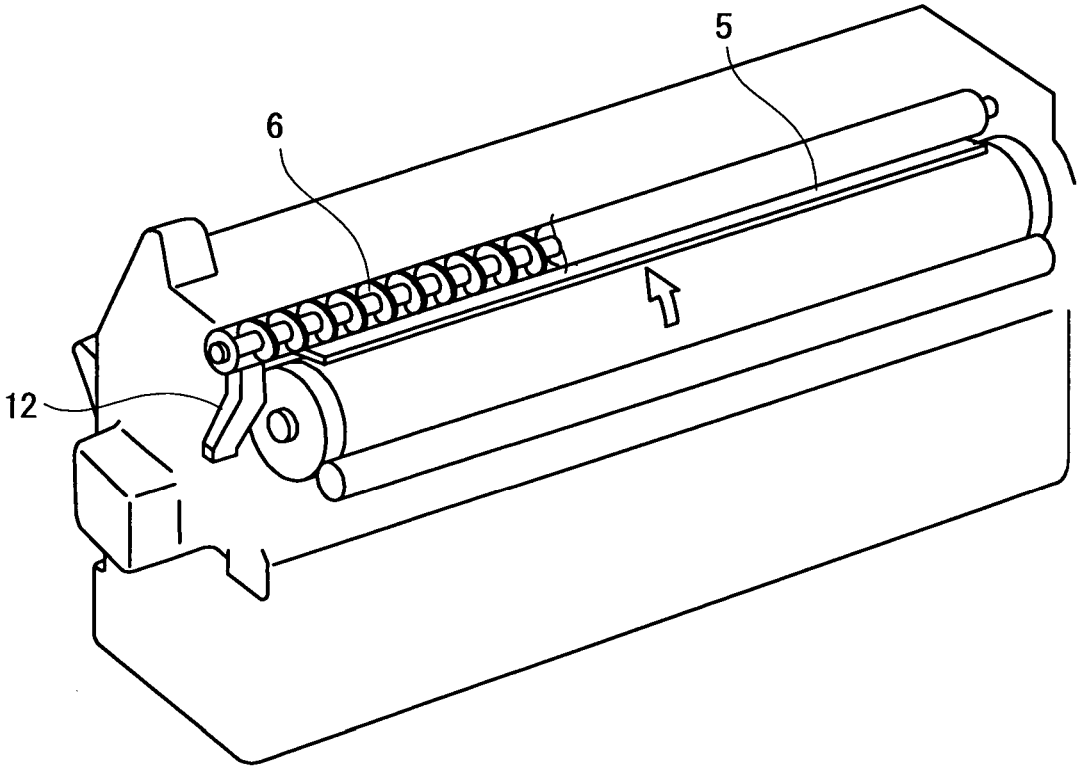
FIG. 3 is a diagram showing an example of a unit for cleaning a photoconductor surface of the image forming apparatus using the image forming process of the present invention.
Figure 4:
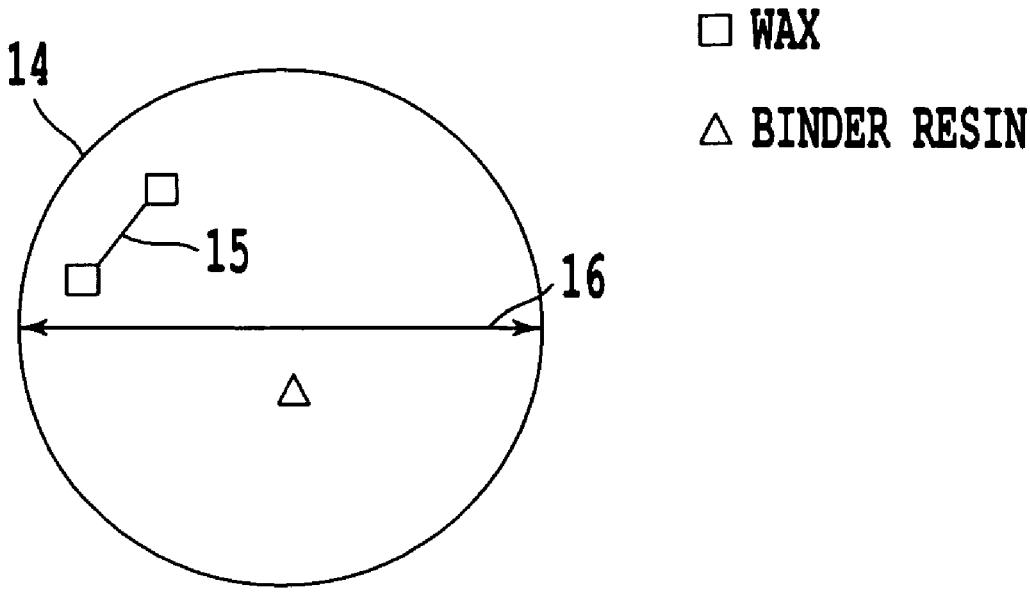
FIG. 4 illustrates a representation of a toner particle 14. A representation of a dispersion diameter 15 of the wax component of the toner particle 14 and the diameter 16 of the toner particle is shown.

In the image forming apparatus of the present invention, as shown in FIG. 3, the cleaning device uses a counter blade method, a rubber blade stuck to a metal plate being brought into contact with the photoconductor surface by spring force. Toner scraped by a cleaning blade (5) is transported from the back to the front by a toner transport screw (6). The transported toner is returned to the developing part as recycled toner via a transport path (12) in front of the cleaning unit.

A fur brush with an auxiliary cleaning function or a mechanism vibrating in the photoconductor axial direction of the blade is not provided. In this cleaning apparatus of simple construction, if wax thinly adheres to or accumulates on the blade edge, as there is no self-repair capacity, there is a risk that uneven wear will progress further. Therefore, some unit must be devised to avoid this situation.

The recycling step is a step which makes the aforesaid developing unit recycle the electrophotographic color toner removed by the aforesaid cleaning step, and may be performed by a recycling unit.

The aforesaid recycling unit is not particularly limited and may be suitably selected from among transport unit known in the art.

The aforesaid control unit is a step which controls the aforesaid steps, and may be implemented by a control unit.

The control unit is not particularly limited and may be suitably selected according to the purpose provided that it can control the operation of each of the aforesaid unit, for example, a device such as a sequencer or a computer.

Here FIG. 1 is a figure showing the layout around the photoconductor in the image forming process of the present invention. This is identical to the ordinary image forming operation. In FIG. 1, the distance between the sensor and the photoconductor sensor "d," the diameter of the charging roller "D1," the diameter of the developing roller "D2," and the diameter of the transferring roller "D3," are illustrated.

The process conditions in the image forming apparatus of the present invention are a system line speed of 100 mm/sec to 200 mm/sec and a developer stirring time for one A4-size copy per original of 4 seconds or more, and it is important that the developer stirring time for one copy per original is 2 to 6 times the developer stirring time per copy in continuous copying.

If the system line speed is less than 100 mm/sec, as the stirring in the developing part is fairly slow, there is low heat and temperature stress which may not be sufficient to cause uneven wear of the photoconductor from smearing of wax on the toner surface. If it is more than 200 mm/sec, as the continuous copying speed is high, the developer stirring time for one copy per original is not much more than the developer stirring time per copy in continuous copying, so image quality deterioration is directly proportional to the number of sheets, and it is unlikely that image-quality stability will be deteriorated due to outputting one sheet at a time.

The original is exposed on a contact glass by a contact lamp, not shown, the reflected light is read by a scanner, and a photoconductor (1) which is uniformly charged by the charge roller (3) is irradiated by an LD light (4). The latent electrostatic image on the photoconductor (1) obtained is rendered visible by a developing roller (11), the toner image thus formed on the photoconductor (1) is transferred to a transfer paper by a transfer roller (9), and the paper is finally ejected via a fixing device, not shown.

In the image forming apparatus of the present invention, to make the whole apparatus more compact, it is preferred that the units surrounding the photoconductor are also made more compact and that the external diameters of the units are as follows:

photoconductor external diameter: 20 mm to 40 mm,
charge roller: 10 mm to 20 mm,
transfer roller: 10 mm to 20 mm,
developing roller: 10 mm to 20 mm.

In the image having forming apparatus of FIG. 1, the external diameters of the units are as follows:

photoconductor external diameter: 30 mm,
charge roller: 16 mm,
transfer roller: 14 mm,
developing roller; 16 mm.

The reflecting photosensor used in the present invention comprises an LED as light-emitting element and a phototransistor as a light-receiving element, these elements being arranged parallel to the photoconductor axis underneath the transfer roller. The part of the reflecting photosensor in which the light receiving and light-emitting elements are embedded facing the photoconductor has an antidust cover, and if this is the detecting surface of the reflecting photosensor, it is preferred that the distance from the sensor detecting surface to the reflecting surface of the photoconductor is 15 mm to 20 mm.

Next, the calibration of the reflecting photosensor in the image forming apparatus will be described.

The calibration of the reflecting photosensor is performed automatically when the power switch of the image forming apparatus is switched ON.

First, a charging voltage and a developing bias voltage are applied as in the case of ordinary image forming while the photoconductor (1) is rotation driven, and a non-image region is formed on the surface of the photoconductor (1). In this region, the light-emitting element of the reflecting photosensor (10) is activated, and the light emission amount of the reflecting photosensor (10), i.e. the current flowing through the light-emitting element, is PWM (pulse width modulation) controlled so that the output voltage (Vsg) of the reflecting photosensor (10) resulting from the reflected light received from the photoconductor (1) by the light-receiving element is 4.0V. This PWM value is expressed by 256 data, and is normally set to 70 to 75 in the case of a new photoconductor. However, if the surface of the photoconductor (1) is unevenly worn, the light reflection efficiency from the photoconductor (1) decreases, and the reflected light amount from the photoconductor (1) decreases. Therefore, the light emission amount adjustment value (PWM value) of the reflecting photosensor (10) to achieve Vsg=4.0V is higher than usual.

Even if the aforesaid deterioration has progressed, Vsg can be adjusted to 4.0V by increasing the PWM value for Vsg adjustment, i.e., by increasing the light emission amount.

However, if the photoconductor surface is unevenly worn, the emitted light incident on streak-like depressions (grooves) formed in the photoconductor circumferential direction cannot be normally reflected by the photoconductor surface. Hence, the photoconductor surface area which allows normally reflected light to be received, is less.

Even if toner does not adhere to streak-like depressions, normal reflection is not obtained, so if toner for the P sensor pattern does adhere to streak-like depressions, there is no attenuation of normally reflected light due thereto, and the presence or absence of toner adhesion cannot be detected from the P sensor output.

Thus, if the photoconductor surface is unevenly worn, even if Vsg adjustment is apparently possible, toner supplementation control by Vsp/Vsg is not appropriately performed, and there is a risk of causing toner scatter or background soiling.

Next, toner density control by the reflecting photosensor (10) will be described.

First, a toner adhesion pattern is formed under predetermined image forming conditions on the photoconductor at irregular intervals at times other than during image forming by calibration of the reflecting photosensor (10), i.e. by the PWM value set when Vsg is adjusted to 4.0V (charge applied voltage: −200V, developing bias voltage: −400V) as described above, and it is determined whether or not the toner adhesion amount of the pattern part is appropriate by the output ratio (Vsp1/Vsg1) of the reflecting sensor detection voltage (Vsp1) and Vsg which is set to approximately 4.0V.

When the charging applied voltage is set to −1450V, the photoconductor surface potential is −150V as described above. Hence, by applying a developing bias voltage of −450V to this part, the toner adhesion pattern is developed at a developing potential voltage of −300V. This is set to only 60% of the developing potential voltage for an ordinary black original, i.e., −500V, and by also making the toner adhesion amount 0.4 mg/cm$^2$ which is less than that of the black fill part, the high sensitivity region of the reflecting photosensor is used.

Figure 2:
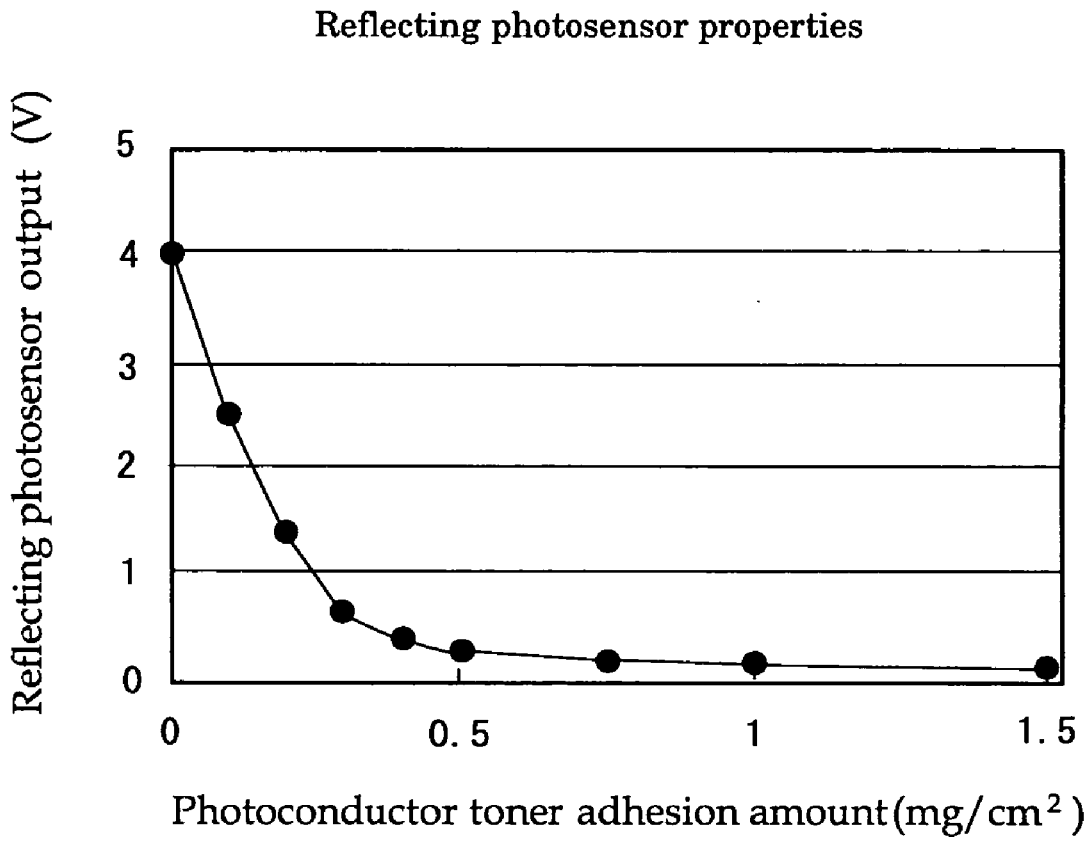
FIG. 2 is a diagram showing reflecting photosensor characteristics.

If the toner adhesion amount of the pattern part is small, the part of the photoconductor surface which is not covered by toner is large, so the light amount which is reflected when the photoconductor is irradiated by a fixed emitted light amount is large, and the value of the sensor output (Vsp1) increases due to the increase of light amount detected by the light-receiving element of the reflecting photosensor (FIG. 2).

If the Vsp1/Vsg1 output ratio is more than a predetermined value (10%), toner is supplemented by the action of toner supplementation control, and the developing capacity increases. Hence, by maintaining the toner amount adhering to the photoconductor at a fixed level, image density is maintained at a fixed level.

If (a) a small diameter photoconductor, and (b) a simple construction cleaning device are installed to achieve low-cost and space-saving, and (c) a remote light reflecting photosensor is installed in a limited space to maintain a stable image density, uneven wear of the photoconductor surface over time is a fatal defect in attempting to maintain stable image quality.

To retain the aforesaid (a), (b) and (c) and uniformly smooth out the uneven wear, the aforesaid toner and photoconductor properties must be controlled within an appropriate range. In particular, the wax dispersion diameter in the toner must be specified to suppress an adverse effect due to wax on the toner surface.

Specifically, according to the present invention, in an image forming process wherein a small diameter organic photoconductor having an outer diameter of 20 mm to 40 mm is installed, comprising a detection unit which detects the toner amount adhering to the photoconductor surface by a reflecting photosensor, a toner supplementation control unit which controls the toner supplementation amount based on the detection result from the detection unit, and a toner recycling mechanism which recovers toner removed from the photoconductor surface by a cleaning device and feeds it back to a developing device, it is preferred that the toner contains a wax component, and that the average dispersion diameter of the wax in the toner is 0.1 μm to 0.8 μm.

If the average dispersion diameter of the wax is less than 0.1 μm, it is advantageous with respect to uneven wear of the photoconductor surface, but fixing qualities are impaired, and offset such as hot offset and cold offset tends to occur. If on the other hand the average dispersion diameter of the wax is more than 0.8 μm, uneven wear of the photoconductor surface is produced.

Herein, the average dispersion diameter of the wax may be obtained by photographing the toner at approximately 10,000 times magnification using a transmitting electron microscope (TEM). Approximately 100 wax pieces dispersed in this toner are selected, and their length in the X axis and Y axis directions is measured. The average of the X axis and Y axis is taken as the particle diameter of one wax piece, and the average of 100 pieces is calculated to give the average dispersion diameter of the wax.

(Toner)

The toner of the present invention is not particularly limited as to manufacturing method, which may be suitably selected according to the purpose, e.g., the toner may be manufactured by suspension polymerization, emulsion polymerization, polymer solution suspension or a dry toner manufacturing method.

Specifically, a binder resin, mold release agent, colorant and charge controlling agent are mixed in a mixer, kneaded by a kneading machine such as a hot roller or extruder, cooled and solidified. The product is crushed by crushing in a jet mill, turbojet or krypton, and classified. An inorganic fine powder may then be mixed with the aforesaid toner in a super mixer or Henschel mixer to obtain the final toner.

The aforesaid binder resin is not particularly limited and may be suitably selected according to the purpose from resins known in the art. For example, polystyrene, poly-α-stilstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene acrylic acid ester copolymer, styrene-methacrylic acid ester copolymer, styrene-α-methyl chloroacrylate copolymer, styrene-acrylonitrile-acrylate copolymer (single polymer or copolymer containing styrene or styrene substituent), polyester resin, epoxy resin, vinyl chloride resin and rosin-modified maleic resin, phenol resin, polyethylene resin, polypropylene resin, petroleum resin, polyurethane resin, ketone resin, ethylene-ethylacrylate copolymer, xylene resin and polyvinyl butyrate resin may be mentioned.

Of these, polyester resin is particularly preferred. Polyester resin is obtained by condensation polymerization of ethyl alcohol and a carboxylic acid. The alcohol used may for example be a glycol such as ethylene glycol, a diene glycol, triethylene glycol or propylene glycol. In addition, 1,4-bis (hydroxymeta) cyclohexane and etherated bisphenols such as bisphenol A, divalent alcohol monomers, or trivalent or higher polyalcohol monomers may be mentioned. Examples of carboxylic acids are maleic acid, fumaric acid, phthalic acid, isophthalic acid, terephthalic acid, succinic acid, divalent organic acid monomers such as malonic acid, or 1,2,4-benzene tricarboxylic acid. In addition, 1,2,5-benzene tricarboxylic acid, 1,2,4-cyclohexane carboxylic acid, 1,2,4-naphthalene tricarboxylic acid and 1,2,5-hexane tricarboxylic acid may be mentioned. Further examples are tribasic and higher polybasic carboxylic acid monomers such as 1,3-dicarboxyl-2-methylene carboxypropane, and 1,2,7,8-octane tetracarboxylic acid.

The above resins can be used alone, but two or more can also be used together.

There is no particular limitation on the resin manufacturing method, i.e., block polymerization, solution polymerization, emulsion polymerization and suspension polymerization.

As colorant, all of the pigments and dyes which have been used as colorants for toners in the prior art may be used. Specific examples are iron black, ultramarine, nigrosine dye, aniline blue, Chalcoyl blue, oil black and azo oil black.

The colorant usage amount is preferably 1 part by mass to 10 parts by mass, but more preferably 3 parts by mass to 7 parts by mass, relative to 100 parts by mass of binder resin.

The mold release agent used in the toner may be any of those known in the art, in particular free fatty acid removal type carnauba wax, montan wax and oxidized rice wax may be used alone or in combination. The carnauba wax may be microcrystalline, but it preferably has an acid value or 5 or less, and the particle size when it is dispersed in the toner binder is preferably 1 μm or less. Montan wax generally refers to montan wax purified from minerals, and as in the case of carnauba wax, it is preferably microcrystalline with an acid value of 5 to 14. Oxidized rice wax is obtained by atmospheric oxidation of rice bran wax, and its acid value is preferably 10 to 30. Other mold-release agents known in the art may also be used in admixture such as solid silicone wax, higher fatty acids/higher alcohols, montan ester waxes and low molecular weight polypropylene wax.

The aforesaid carnauba wax may be a natural wax obtained from the leaves of the *Copenicia cerifera* Mart, and as the type from which free fatty acids have been removed and which has a low acid value can be uniformly dispersed in the binder resin, this is particularly preferred.

The aforesaid rice wax may be a natural wax obtained by refining crude wax produced by a wax removal or wintering step when rice sugar oil extracted from rice sugar is refined.

The aforesaid synthetic ester wax is synthesized by an esterification reaction from a monofunctional straight chain fatty acid and a monofunctional straight chain alcohol.

These wax components may be used alone or in combination. The addition amount of the wax component is preferably 0.5 parts by mass to 10 parts by mass relative to 100 parts by mass of the aforesaid binder resin.

Inorganic fine particles are preferably used as the external additive. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by mass to 5.0% by mass, and more preferably from 0.01% by mass to 2.0% by mass of the toner.

Examples of the inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these additives to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, and an aluminium coupling agent.

The toner may further comprise a charge control agent according to necessity. Charge control agents include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The aforesaid additive has a polishing effect on the photoconductor, and has the function of uniformly polishing uneven parts which have been scratched by a physical force such as the aforesaid developing sleeve.

The total amount of additive added to the toner surface is preferably 0.5% by mass to 2.0% by mass relative to the toner mass prior to addition. If the total additive amount in the toner is less than 0.5% by mass, it is difficult to abrade the photoconductor and unevenness remains, whereas if the total additive amount in the toner is more than 2.0% by mass, the photoconductor is abraded too much which shortens its life, and fixing qualities also deteriorate.

The toner dynamic frictional coefficient must be 0.15 to 0.45, but is preferably 0.20 to 0.35. If the toner dynamic frictional coefficient is less than 0.15, the wax amount of the toner surface is too high, unevenness occurs in the wax amount which has leaked from the toner calculated on the cleaning blade edge, so some parts of the photoconductor have a high frictional coefficient and other parts have a low frictional coefficient which leads to uneven wear of the photoconductor. If the toner dynamic frictional coefficient is more than 0.45, the toner surface wax amount is too small so that fixing offset occurs.

Herein, the toner surface frictional resistance may be measured by, for example, measuring disk-shaped pellets of diameter 40 mm produced by applying a load of 6 t/cm$^2$ to a 3 g mass of toner for 60 seconds using a fully automatic frictional wear analyzer manufactured by Kyowa Interface Science Co., LTD. In this measurement, a 3 mm stainless ball point contact is used as the contact.

In the present invention, in the ATR method using FT-IR, if the characteristic peak height in the wax spectrum is W and the characteristic peak height in the resin spectrum is R, the wax-peak ratio expressed by W/R is preferably 0.15 to 0.40. The wax peak ratio of the toner surface is calculated from the peak intensity ratio which can be found from the ATR spectrum in the ATR method using FT-IR. As a smooth surface is required in the ATR method, the toner is pressure-molded to obtain a smooth surface. In this pressure-molding, a load of it was applied to 0.6 g of toner for 30 seconds to obtain pellets of diameter 20 mm.

Herein, taking the resin as being a substance without any non-uniformity of distribution in the toner, and taking the peak height of the characteristic wax spectrum (2,918 cm$^{-1}$) as W and the peak height of the characteristic resin spectrum (e.g., in the case of polyester resin, 829 cm$^{-1}$, and in the case of styrene-acrylic resin, 697 cm$^{-1}$) as R, W/R was calculated as the peak intensity ratio. The peak intensity ratio in the present invention was obtained by converting the spectrum to a light absorption degree, and using this peak height.

If the wax peak ratio is small, it shows that the wax amount of the toner surface is small, and if the wax peak ratio is large, it shows that the wax amount of the toner surface is large. An appropriate range for the wax peak ratio is 0.12 to 0.40. If the wax the ratio is less than 0.12, it is advantageous from the viewpoint of uneven wear of the photoconductor surface, but fixing qualities are impaired, and offset such as hot offset and cold offset tends to occur. Conversely, if it is more than 0.40, the wax amount on the toner surface is too large, there is unevenness in the wax amount leaking from the toner accumulated on the cleaning blade edge, so there are some parts of the photoconductor with a high frictional coefficient and other parts with a low frictional coefficient which may lead to uneven wear of the photoconductor.

The average circularity of the toner is preferably 0.91 to 0.98. If the average circularity is less than 0.91, there is a large scatter in toner shape, which tends to cause local scratching of the photoconductor. If the circularity is more than 0.98, the toner shaper is spherical, so it tends to slip off the sleeve which may impair blade cleaning qualities.

Herein, the average circularity of the toner was measured by measuring with a SYSMEX Flow Type Particle Image Analyzer FPIA-2100. The measurement is performed by adding 0.1 ml to 5 ml of an alkylbenzene sulfonate as dispersing agent to 50 ml to 100 ml of a solution obtained by passing through a 0.5 μm filter after adjusting with 1% NaCl aqueous solution using extra pure sodium chloride, and adding 1 mg to 10 mg of sample. This was subjected to dispersion processing in an ultrasonic disperser for one minute, and the measurement was performed using a dispersion solution wherein the particle concentration had been adjusted to 5,000 particles/μl to 15,000 particles/μl. Taking the diameter of a circle having identical surface area to a two-dimensional image surface area photographed with a CCD camera as an equivalent circle diameter, and taking particles having a circle equivalent diameter of 0.6 μm or more as valid from the precision of the CCD image, this was used to compute the average circularity. The average circularity can be obtained by computing the circularity of all the particles, summing the circularity of these particles and dividing by the total number of particles. The average circularity of the particles is computed by dividing the circumferential length of a circle having a projected surface area identical to that of the particle image, by the circumferential length of a projected image of the particle.

The volume average particle diameter of the toner is preferably 4 μm to 10 μm. If the volume average particle diameter is less than 4.0 μm, toner production qualities are poor and fluid qualities are remarkably impaired which is undesirable. On the other hand, it is more than 10.0 μm, image quality may be impaired which is undesirable. The volume average particle diameter may for example be measured using a Coulter MULTISIZER IIe. The aperture diameter is 100 μm.

The cohesion degree of the toner is preferably 5 to 30%, but more preferably 10% to 20%. If the cohesion degree is less than 5%, toner particles tend to move individually, so it is difficult to abrade the photoconductor. If the cohesion degree of the toner is more than 30%, toner adheres strongly together, but the force of toner adhesion to the photoconductor also increases so that the photoconductor may be abraded too much.

Herein, the cohesion degree of the toner can be measured for example using a powder tester (PTN: Hosokawa Micron Corporation). The sieves used are 75 μm, 45 μm, 22 μm, and the toner was vibrated at an amplitude of 1.0 mm for 30 seconds.

Hereafter, the present invention will be described in detail by units of examples. It should however be understood that the present invention is not to be construed as being limited in any way thereby.

The method of measuring the features of the present invention will first be described.

<Wax Peak Ratio Measurement>

The wax peak ratio of the toner surface is found from the peak intensity ratio obtained from the ATR spectrum by the ATR method using FT-IR. In the ATR method, a smooth surface is required, so the toner is pressure-molded to create a smooth surface. In this pressure molding, a load of 1 t was applied to 0.6 g toner for 30 seconds to produce pellets of diameter 20 mm.

According to the present invention, taking the resin as being a substance without any non-uniformity of distribution in the toner, and taking the peak height of the characteristic wax spectrum (2,918 cm$^{-1}$) as W and the peak height of the characteristic resin spectrum (e.g., in the case of polyester resin, 829 cm$^{-1}$, and in the case of styrene-acrylic resin, 697 cm$^{-1}$) as R, W/R was calculated as the peak intensity ratio. The peak intensity ratio in the present invention was obtained by converting the spectrum to a light absorption degree, and using this peak height.

<Measurement of Dynamic Frictional Coefficient>

The toner surface frictional resistance was measured by measuring disk-shaped pellets of diameter 40 mm produced by applying a load of 6 t/cm$^2$ to a 3 g mass of toner for 60 seconds using a fully automatic frictional wear analyzer (Kyowa Interface Science Co., LTD.). In this measurement, a 3 mm stainless ball point contact is used as the contact.

<Measurement of Average Circularity>

The average circularity can be measured by measuring using a Flow Type Particle Image Analyzer FPIA-2100 (SYSMEX). The measurement is performed by adding 0.1 ml to 5 ml of an alkylbenzene sulfonate as dispersing agent to 50 ml to 100 ml of a solution obtained by passing through a 0.5 μm filter after adjusting with 1% NaCl aqueous solution using extra pure sodium chloride, and adding 1 mg to 10 mg of sample. This was subjected to dispersion processing in an ultrasonic disperser for one minute, and the measurement was performed using a dispersion solution wherein the particle concentration had been adjusted to 5,000 particles/μl to 15,000 particles/μl. Taking the diameter of a circle having identical surface area to a two-dimensional image surface area photographed with a CCD camera as an equivalent circle diameter, and taking particles having a circle equivalent diameter of 0.6 μm or more as valid from the precision of the CCD image, this was used to compute the average circularity. The average circularity can be obtained by computing the circularity of all the particles, summing the circularity of these particles and dividing by the total number of particles. The average circularity of the particles is computed by dividing the circumferential length of a circle having a projected surface area identical to that of the particle image, by the circumferential length of the projected image of the particle.

<Volume Average Particle Diameter of Toner>

The volume average particle diameter of the toner can be measured by various methods, but in the present invention, it is convenient to use a Coulter counter.

Specifically, in the measurement apparatus, using a Coulter counter TA-II (Coulter Ltd.), an interface (Nikka Instruments) which outputs number distribution and volume distribution and a CX-1 personal computer (Canon) were connected, and the electrolyte was adjusted with approximately 1% NaCl aqueous solution using reagent quality sodium chloride. For example, ISOTONR-II (Coulter Scientific Japan) may be used. As the measurement method, 0.5 ml to 1 ml of alkylbenzene sulphonate was added as dispersing agent to 100 ml to 150 ml of the aforesaid aqueous electrolyte solution, and 2 mg to 20 mg of the measurement sample was added. The electrolyte in which the sample was suspended was subjected to dispersion treatment for approximately 1 minute to 3 minutes in an ultrasonic disperser, and the volume average particle diameter of the toner was calculated using a 100 μm aperture as the aperture in the aforesaid Coulter Counter TA-II.

<Measurement of Cohesion Degree>

The cohesion degree was measured as follows.

Measuring apparatus: Powder Tester PT-N Hosokawa Micron Corporation

Operating method: The instructions in the specification of the "Powder Tester PT-N" were basically followed except for the following points:

1) Sieves used: 75 μm, 45 μm, 22 μm

2) Vibration time: 30 sec

<Evaluation Apparatus>

In the present invention, a modified Ricoh imagio Neo 270 copier was used.

The process conditions of the evaluation apparatus were as follows:

Photoconductor outer diameter: 30 mm, charge roller: 16 mm, transfer roller: 14 mm, developing roller: 16 mm, fixed photoconductor cleaning blade and reflecting photosensor mechanism. The system speed was 150 mm/sec, the developer stirring time per copy for one original was 7.5 seconds, and the developer stirring time per copy for one original was 2 to 5 times the developer stirring time per copy for one original during continuous copying.

<Test Method>

50,000 copies (printing rate 6%) were continuously produced by the aforesaid modified Ricoh imagio Neo 270. The image was evaluated according to image sample after 50,000 copies, i.e., 3 black fills (A3) and 3 white fills (A3) were output, image uniformity and fixing qualities were evaluated for the black fill, and background soiling was evaluated for the white fill.

<Black fill image uniformity (density difference)>

Evaluation criteria by image density

◎: Less than 0.1

○: 0.1 to 0.2

Δ: 0.2 to 0.3

□: 0.3 to 0.4

X: More than 0.4

<Black Fill Image Fixing Qualities (Fixing Rate)>

A mending tape (3M) was affixed to a black fill image, pressure was uniformly applied without leaving any air gaps, and the tape was then gently peeled off. The image density was measured before and after using a Macbeth densitometer, and the fixing rate was computed by the following equation:

Fixing rate (%)=(image density after peeling off tape/image density before peeling off tape)×100

Evaluation Criteria by Fixing Rate

◎: Less than 10%

○: 10% to 20%

Δ: 20% to 30%

□: 30% to 40%

X: 40% or more

<White Fill Background Soiling>

Determination criteria depending on background soiling

◎: Good

○: Fair

Δ: Average

□: Rather poor

X: Poor

EXAMPLE 1

(Toner Ingredients)

| | |
|---|---|
| Polyester resin (Weight average molecular weight: 68,200, Tg: 65.5° C.) | 89 parts by mass |
| Rice wax | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 120° C., crushed in an air crusher and classified to give a volume average particle diameter of 11.0 μm, and 2.2% by mass silica (R-972: Nippon Aerogel) was then mixed together using a Henschel mixer to obtain a toner.

The dynamic frictional coefficient of the obtained toner was 0.25, the wax peak ratio of the obtained toner was 0.153, the photoconductor surface frictional coefficient was 0.27, the toner circularity was 0.90, the volume average particle diameter was 11 μm and the cohesion degree was 3%. A carrier of magnetite particles of average particle diameter 50 μm coated with silicone resin (film thickness 0.5 μm), was mixed with the aforesaid toner at a toner concentration of 5.0% by mass to obtain the developer of the present invention. The evaluation was performed using the aforesaid evaluation apparatus and evaluation method. Table 1 shows the results.

EXAMPLE 2

A sample was manufactured in an identical way to that of Example 1 except that 3 parts by mass of wax were used and the toner dynamic frictional coefficient was 0.43, the wax peak ratio of the obtained toner was 0.122, and an identical evaluation was performed. Table 1 shows the results.

COMPARATIVE EXAMPLE 1

A sample was manufactured in an identical way to that of Example 1 except that 5.5 parts by mass of wax were used and the toner dynamic frictional coefficient was 0.13, the wax peak ratio of the obtained toner was 0.42, and an identical evaluation was performed. Table 1 shows the results.

2% by mass the wax peak ratio of the obtained toner was 0.153, and the cohesion degree was 4%, and an identical evaluation was performed. Table 1 shows the results.

EXAMPLE 5

A sample was prepared in an identical way to that of Example 4 except that the toner circularity was 0.92, the wax peak ratio of the obtained toner was 0.153, and an identical evaluation was performed. Table 1 shows the results.

EXAMPLE 6

A sample was prepared in an identical way to that of Example 5 except that the toner volume average particle diameter was 9.5 μm, and the wax peak ratio of the obtained toner was 0.153. Table 1 shows the results.

EXAMPLE 7

A sample was prepared in an identical way to that of Example 6 except that the total toner addition amount was 1.7% by mass, the wax peak ratio of the obtained toner was 0.153, and the cohesion degree was 10%, and an identical evaluation was performed. Table 1 shows the results.

TABLE 1

| | Dynamic frictional coefficient | Photoconductor surface frictional coefficient | Total additive amount (mass %) | Circularity | Volume average particle diameter (μm) | Cohesion degree (%) | Density difference | Fixing ratio | Background soiling level | Wax peak ratio |
|---|---|---|---|---|---|---|---|---|---|---|
| Example 1 | 0.25 | 0.27 | 2.2 | 0.90 | 11 | 3 | Δ | Δ | Δ | 0.153 |
| Example 2 | 0.43 | 0.27 | 2.2 | 0.90 | 11 | 3 | Δ | Δ | Δ | 0.122 |
| Example 3 | 0.25 | 0.5 | 2.2 | 0.90 | 11 | 3 | ○ | Δ | Δ | 0.153 |
| Example 4 | 0.25 | 0.5 | 2.0 | 0.92 | 11 | 4 | ○ | ○ | ○ | 0.153 |
| Example 5 | 0.25 | 0.5 | 2.0 | 0.92 | 11 | 4 | ◎ | ○ | ○ | 0.153 |
| Example 6 | 0.25 | 0.5 | 2.0 | 0.92 | 9.5 | 4 | ◎ | ◎ | ○ | 0.153 |
| Example 7 | 0.25 | 0.5 | 1.7 | 0.92 | 9.5 | 10 | ◎ | ◎ | ◎ | 0.153 |
| Comp. Ex. 1 | 0.13 | 0.27 | 2.2 | 0.90 | 11 | 3 | x | ◎ | ○ | 0.42 |
| Comp. Ex. 2 | 0.47 | 0.27 | 2.2 | 0.90 | 11 | 3 | ○ | x | ○ | 0.118 |

COMPARATIVE EXAMPLE 2

A sample was manufactured in an identical way to that of Example 1 except that 2.5 parts by mass of wax were used and the toner dynamic frictional coefficient was 0.47, the wax peak ratio of the obtained toner was 0.118, and an identical evaluation was performed. Table 1 shows the results.

EXAMPLE 3

A sample was manufactured in an identical way to that of Example 1 except that the photoconductor surface frictional coefficient was 0.5, the wax peak ratio of the obtained toner was 0.153, and an identical evaluation was performed. Table 1 shows the results.

EXAMPLE 4

A sample was prepared in an identical way to that of Example 3 except that the total toner addition amount was The toners of Examples 8 to 21 and Comparative Examples 3 to 4 were prepared, and their properties were evaluated. In these examples, the case of a two-component toner is shown, but a non-magnetic one-component toner or a magnetic one-component toner may be used.

EXAMPLE 8

(Toner Ingredients)

| | |
|---|---|
| Polyester resin (Weight average molecular weight: 28,000, Tg: 65° C.) | 90 parts by mass |
| Carnauba wax | 4 parts by mass |
| Carbon black (Mitsubishi Chemicals: #44) | 5 Parts by mass |
| Charge controlling agent (Spiron Black TR-H: Hodogaya Chemical Co., Ltd.) | 1 part by mass |

The above ingredients were kneaded together using a 2-axis extruder at 70° C., crushed in an air crusher and classified to give a volume average particle diameter of 3.7 μm, and 2.5% by mass silica (R-972: Nippon Aerogel) was then mixed together using a Henschel mixer to obtain a toner. Table 2 shows the properties of this toner.

A carrier of magnetite particles of average particle diameter 50 μm coated with methyl methacrylate resin (MMA, film thickness 0.5 μm), was mixed with the aforesaid toner at a toner concentration of 5.0% by mass to obtain the developer of the present invention.

EXAMPLE 9

(Toner Ingredients)

| | |
|---|---|
| Polyester resin (Weight average molecular weight: 28,000, Tg: 65° C.) | 90 parts by mass |
| Carnauba wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 150° C., crushed in an air crusher and classified to give a volume average particle diameter of 11.0 μm, and 0.4% by mass silica (R-972: Nippon Aerogel) was then mixed together using a Henschel mixer to obtain a toner.

Table 2 shows the properties of this toner.

COMPARATIVE EXAMPLE 3

(Toner Ingredients)

| | |
|---|---|
| Polyester resin (Weight average molecular weight: 35,000, Tg: 64° C.) | 90 parts by mass |
| Polyethylene wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 60° C., crushed in an air crusher, classified to give a volume average particle diameter of 3.8 μm, and 2.2% by mass silica (R-972: Nippon Aerogel) was then mixed together using a Henschel mixer to obtain a toner.

Table 2 shows the properties of this toner.

COMPARATIVE EXAMPLE 4

(Toner Ingredients)

| | |
|---|---|
| Polyester resin (Weight average molecular weight: 22,000, Tg: 60° C.) | 88 parts by mass |
| Polyethylene wax | 6 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 160° C., crushed in an air crusher, classified to give a volume average particle diameter of 11.5 μm, and 0.45% by mass silica (R-972: Nippon Aerogel) was then mixed together using a Henschel mixer to obtain a toner.

Table 2 shows the properties of this toner.

<Evaluation of Uneven Wear>

50,000 copies were made using an imagio MF6550 (Ricoh). An A3 all-black fill image was then obtained from an all-black fill original (original density: 1.70). The A3 all-black fill image was measured by a Macbeth densitometer, the value for the part with the lowest image density was subtracted from the value for the part with the highest image density, and evaluated as ΔID. As image density unevenness increases with the uneven wear of the photoconductor, ΔID increases the worse is the uneven wear.

<Evaluation of Hot Offset Temperature>

Using an imagio MF6550 (Ricoh), the heater temperature was raised and copies were made. The temperature at which hot offset started to appear was taken as the hot offset temperature.

Hot offset qualities are better, the higher is the hot offset temperature.

Table 3 shows uneven wear properties and hot offset temperature evaluation results.

EXAMPLE 10

(Toner Ingredients)

| | |
|---|---|
| Polyester resin (Weight average molecular weight: 25,000, Tg: 64° C.) | 90 parts by mass |
| Rice wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 80° C., crushed in an air crusher and classified to give a volume average particle diameter of 10.5 μm, and 0.45% by mass silica (R-972: Nippon Aerogel) was then mixed together using a Henschel mixer to obtain a toner.

Table 2 shows the properties of this toner, and Table 3 shows uneven wear properties and hot offset temperature evaluation results.

EXAMPLE 11

(Toner Ingredients)

| | |
|---|---|
| Polyester resin (Weight average molecular weight: 25,000, Tg: 64° C.) | 89 parts by mass |
| Rice wax | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 130° C., crushed in an air crusher and classified to give a volume average particle diameter of 10.5 μm, and 0.45% by mass silica (R-972: Nippon Aerogel) was then mixed together using a Henschel mixer to obtain a toner.

Table 2 shows the properties of this toner, and Table 3 shows uneven wear properties and hot offset temperature evaluation results.

EXAMPLE 12

(Toner Ingredients)

| | |
|---|---|
| Polyester resin (Weight average molecular weight: 27,500, Tg: 66° C.) | 90 parts by mass |
| Carnauba wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 50° C., crushed in an air crusher and classified to give a volume average particle diameter of 10.5 μm, and 2.50% by mass silica (R-972: Nippon Aerogel) was then mixed together using a Henschel mixer to obtain a toner.

Table 2 shows the properties of this toner, and Table 3 shows uneven wear properties and hot offset temperature evaluation results.

EXAMPLE 13

(Toner Ingredients)

| | |
|---|---|
| Polyester resin (Weight average molecular weight: 27,500, Tg: 66° C.) | 89 parts by mass |
| Carnauba wax | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 130° C., crushed in an air crusher and classified to give a volume average particle diameter of 10.5 μm, and 2.50% by mass silica (R-972: Nippon Aerogel) was then mixed together using a Henschel mixer to obtain a toner.

Table 2 shows the properties of this toner, and Table 3 shows uneven wear properties and hot offset temperature evaluation results.

EXAMPLE 14

(Toner Ingredients)

| | |
|---|---|
| Polyester resin (Weight average molecular weight: 27,500, Tg: 66° C.) | 70 parts by mass |
| Styrene-butylacrylate copolymer (Weight average molecular weight: 55,000, Tg: 68° C.) | 20 parts by mass |
| Carnauba wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 80° C., crushed in an air crusher and classified to give a volume average particle diameter of 10.5 μm, and 0.45% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 15

(Toner ingredients)

| | |
|---|---|
| Polyester resin (Weight average molecular weight: 27,500, Tg: 66° C.) | 69 parts by mass |
| Styrene-butylacrylate copolymer (Weight average molecular weight: 55,000, Tg: 68° C.) | 20 parts by mass |
| Carnauba wax | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 150° C., crushed in an air crusher and classified to give a volume average particle diameter of 10.5 μm, and 2.20% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 16

(Toner Ingredients)

| | |
|---|---|
| Polyester resin (Weight average molecular weight: 22,500, Tg: 64° C.) | 70 parts by mass |
| Styrene-butylacrylate copolymer (Weight average molecular weight: 55,000, Tg: 68° C.) | 20 parts by mass |
| Carnauba wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 90° C., crushed in an air crusher and classified to give a volume average particle diameter of 10.4 μm, and 0.45% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 17

(Toner Ingredients)

| | |
|---|---|
| Polyester resin (Weight average molecular weight: 22,500, Tg: 64° C.) | 69 parts by mass |
| Styrene-butylacrylate copolymer (Weight average molecular weight: 55,000, Tg: 68° C.) | 20 parts by mass |
| Carnauba wax | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 150° C., crushed in an air crusher and classified to give a volume average particle diameter of 10.4 μm, and 0.45% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 18

(Toner Ingredients)

| | |
|---|---|
| Polyester resin (Weight average molecular weight: 22,500, Tg: 64° C.) | 60 parts by mass |
| Styrene-butylacrylate copolymer (Weight average molecular weight: 24,000, Tg: 68° C.) | 30 parts by mass |
| Low molecular weight polypropylene | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 100° C., crushed in an air crusher and classified to give a volume average particle diameter of 10.7 μm, and 0.75% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 19

(Toner Ingredients)

| | |
|---|---|
| Polyester resin (Weight average molecular weight: 22,500, Tg: 64° C.) | 59 parts by mass |
| Styrene-butylacrylate copolymer (Weight average molecular weight: 24,000, Tg: 68° C.) | 30 parts by mass |
| Low molecular weight polypropylene | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 140° C., crushed in an air crusher and classified to give a volume average particle diameter of 10.7 μm, and 1.50% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 20

(Toner Ingredients)

| | |
|---|---|
| Polyester resin (Weight average molecular weight: 37,400, Tg: 67° C.) | 65 parts by mass |
| Styrene-butylacrylate copolymer (Weight average molecular weight: 22,000, Tg: 67° C.) | 25 parts by mass |
| Carnauba wax | 4 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 100° C., crushed in an air crusher and classified to give a volume average particle diameter of 5.5 μm, and 1.00% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

EXAMPLE 21

(Toner Ingredients)

| | |
|---|---|
| Polyester resin (Weight average molecular weight: 37,400, Tg: 67° C.) | 64 parts by mass |
| Styrene-butylacrylate copolymer (Weight average molecular weight: 22,000, Tg: 67° C.) | 25 parts by mass |
| Carnauba wax | 5 parts by mass |
| Carbon black (Mitsubishi Chemicals: #44) | 5 parts by mass |
| Charge controlling agent (Spiron Black TR-H: Hodogaya Chemical Co., Ltd.) | 1 part by mass |

The above ingredients were kneaded together using a 2-axis extruder at 140° C., crushed in an air crusher and classified to give a volume average particle diameter of 9.5 μm, and 0.75% by mass silica (R-972: Nippon Aerogel) was then mixed together using a Henschel mixer to obtain a toner.

Table 2 shows the properties of this toner, and Table 3 shows the uneven wear properties and hot offset temperature evaluation results.

TABLE 2

| | Wax average dispersion diameter (μm) | Dynamic frictional coefficient | Wax peak ratio | Cohesion degree (%) | Average circularity | Total additive amount (mass %) | Volume average particle diameter (μm) |
|---|---|---|---|---|---|---|---|
| Example 8 | 0.20 | 0.22 | 0.13 | 4 | 0.90 | 2.50 | 3.7 |
| Example 9 | 0.70 | 0.45 | 0.45 | 33 | 0.90 | 0.40 | 11.0 |
| Comp. Ex. 3 | 0.05 | 0.14 | 0.11 | 4 | 0.90 | 2.20 | 3.8 |
| Comp. Ex. 4 | 1.20 | 0.55 | 0.51 | 35 | 0.90 | 0.45 | 11.5 |
| Example 10 | 0.35 | 0.43 | 0.14 | 32 | 0.90 | 0.45 | 10.5 |
| Example 11 | 0.50 | 0.27 | 0.42 | 34 | 0.90 | 0.45 | 10.5 |
| Example 12 | 0.20 | 0.39 | 0.18 | 4 | 0.90 | 2.50 | 10.5 |
| Example 13 | 0.70 | 0.26 | 0.37 | 4 | 0.90 | 2.50 | 10.5 |
| Example 14 | 0.30 | 0.35 | 0.20 | 10 | 0.90 | 0.45 | 10.5 |
| Example 15 | 0.60 | 0.27 | 0.34 | 25 | 0.90 | 2.20 | 10.5 |
| Example 16 | 0.50 | 0.35 | 0.22 | 20 | 0.92 | 0.45 | 10.4 |
| Example 17 | 0.60 | 0.33 | 0.25 | 15 | 0.97 | 0.45 | 10.4 |
| Example 18 | 0.25 | 0.40 | 0.19 | 22 | 0.95 | 0.75 | 10.7 |
| Example 19 | 0.55 | 0.31 | 0.24 | 7 | 0.94 | 1.50 | 10.7 |
| Example 20 | 0.40 | 0.31 | 0.22 | 12 | 0.93 | 1.00 | 5.5 |
| Example 21 | 0.60 | 0.36 | 0.31 | 18 | 0.96 | 0.75 | 9.5 |

TABLE 3

| | Uneven photoconductor wear | Hot offset temperature (° C.) |
|---|---|---|
| Example 8 | 0.22 | 220 |
| Example 9 | 0.31 | 240 |
| Comp. Ex. 3 | 0.45 | 175 |
| Comp. Ex. 4 | 1.34 | 220 |
| Example 10 | 0.20 | 225 |
| Example 11 | 0.30 | 240 |
| Example 12 | 0.19 | 230 |
| Example 13 | 0.28 | 235 |
| Example 14 | 0.15 | 240 |
| Example 15 | 0.25 | 245 |
| Example 16 | 0.11 | 250 |
| Example 17 | 0.19 | 250 |
| Example 18 | 0.05 | 250 |
| Example 19 | 0.10 | 250 |
| Example 20 | 0.05 | 250 |
| Example 21 | 0.07 | 250 |

The present invention provides an image forming process wherein, in an image forming apparatus designed for low-cost and small space, uneven wear of a photoconductor over time is suppressed by combining a developer having an appropriate toner dynamic frictional coefficient which is affected by surface wax with the most suitable processes.

The present invention provides an image forming process wherein, in an image forming apparatus designed for low-cost and small space, uneven wear of a photoconductor over time is suppressed by using the method in combination with a developer having an appropriate wax dispersion diameter in a toner which is affected by surface wax.

What is claimed is:

1. An image forming apparatus comprising:

a photoconductor;

a latent electrostatic image forming unit for forming a latent electrostatic image on the photoconductor;

a developer amount detection unit for detecting developer amount adhering to the photoconductor surface by a reflecting photosensor;

a developing unit for developing the latent electrostatic image using a developer comprising a toner to form a visible image, and configured to have a developer stirring time per copy when one copy is made from an original which is 2 to 6 times the developer stirring time per copy when two or more copies are made from the original;

a transfer unit for transferring the visible image to a recording medium; and a cleaning unit for removing the developer on the photoconductor surface, wherein the toner comprises a binder resin and a wax, the dynamic frictional coefficient of the toner is 0.15 to 0.45, and the wax peak intensity ratio expressed by the following Equation 1 on the toner surface is 0.12 to 0.4, $$\text{Wax peak intensity ratio} = W/R \qquad \text{<Equation 1>}$$

wherein, "W" expresses the peak height of the characteristic spectrum of the wax calculated by the ATR method using FT-IR, and "R" is the peak height of the characteristic spectrum of the resin calculated by the ATR method using FT-IR.

2. An image forming apparatus according to claim 1, wherein the average dispersion diameter of the wax in the toner is 0.1 μm to 0.8 μm.

3. An image forming apparatus according to claim 1, wherein the average circularity of the toner is 0.91 to 0.98.

4. An image forming apparatus according to claim 1, wherein the volume average particle diameter of the toner is 4 μm to 10 μm.

5. An image forming apparatus according to claim 1, wherein the cohesion degree of the toner is 5% to 30%.

6. An image forming apparatus according to claim 1, wherein the total amount of additive added to the toner surface is 0.5% by mass to 2.0% by mass relative to the toner mass prior to addition.

7. An image forming apparatus according to claim 1, wherein the developer is one of a one-component developer and a two-component developer.

8. An image forming apparatus according to claim 1, wherein the outer diameter of the photoconductor is 20 mm to 40 mm.

9. An image forming apparatus according to claim 1, wherein the photoconductor is an organic photoconductor.

10. An image forming apparatus according to claim 1, wherein the photoconductor comprises a photoconducting layer containing an organic photo-semiconductor.

11. An image forming apparatus according to claim 1, wherein the surface frictional coefficient of the photoconductor is 0.3 to 0.7.

12. An image forming apparatus according to claim 1, wherein the system line speed of the image forming apparatus is 100 mm/sec to 200 mm/sec.

13. An image forming apparatus according to claim 1, wherein the developer stirring time when one A4 copy is made from one original, is 4 seconds or more.

14. An image forming apparatus according to claim 1, wherein the reflecting photosensor is a remote type, and the distance between the sensor and the photoconductor surface is 15 mm to 25 mm.

15. An image forming apparatus according to claim 1, further comprising a developer amount control unit which controls the supplementary amount of developer in the developing unit based on the detection result of the developer amount detection unit.

16. An image forming apparatus according to claim 1, wherein the cleaning unit is a counter blade.

17. An image forming apparatus according to claim 1, further comprising a toner recycling unit which recovers the toner removed from the photoconductor surface by the cleaning unit, and feeds it back to the developing unit.

18. An image forming apparatus according to claim 1, wherein the latent electrostatic image forming unit contains a charge roller having an outer diameter of 10 mm to 20 mm, the developing unit contains a developing roller having an outer diameter of 10 mm to 20 mm, and the transfer unit contains a transfer roller having an outer diameter of 10 mm to 20 mm.

19. An image forming process comprising the steps of:

forming a latent electrostatic image on a photoconductor;

developing the latent electrostatic image using a developer comprising a toner to form a visible image;

detecting developer amount adhering to the photoconductor surface by a reflecting photosensor;

transferring the visible image to a recording medium; and cleaning the developer on the photoconductor surface, wherein the developer stirring time per copy when one copy is made from an original, is 2 to 6 times the developer stirring time per copy when two or more copies are made from an original, wherein the toner comprises a binder resin and a wax, the dynamic frictional coefficient of the toner is 0.15 to 0.45, and the wax peak intensity ratio expressed by the following Equation 1 on the toner surface is 0.12 to 0.4

$$\text{Wax peak intensity ratio} = W/R \qquad \text{<Equation 1>}$$

wherein "W" expresses the peak height of the characteristic spectrum of the wax calculated by the ATR method using FT-IR, and "R" is the peak height of the characteristic spectrum of the resin calculated by the ATR method using FT-IR.

20. An image forming process according to claim 19, wherein the average dispersion diameter of the wax in the toner is 0.1 μm to 0.8 μm.

21. An image forming process according to claim 19, wherein the average circularity of the toner is 0.91 to 0.98.

22. An image forming process according to claim 19, wherein the volume average particle diameter of the toner is 4 μm to 10 μm.

23. An image forming process according to claim 19, wherein the cohesion degree of the toner is 5% to 30%.

24. An image forming process according to claim 19, wherein the total amount of additive added to the toner surface is 0.5% by mass to 2.0% by mass relative to the toner mass prior to addition.

25. An image forming process according to claim 19, wherein the developer is one of a one-component developer and a two-component developer.

26. An image forming process according to claim 19, wherein the outer diameter of the photoconductor is 20 mm to 40 mm.

27. An image forming process according to claim 19, wherein the photoconductor is an organic photoconductor.

28. An image forming process according to claim 19, wherein the photoconductor comprises a photoconducting layer containing an organic photo-semiconductor.

29. An image forming process according to claim 19, wherein the surface frictional coefficient of the photoconductor is 0.3 to 0.7.

30. An image forming process according to claim 19, wherein the system line speed is 100 mm/sec to 200 mm/sec.

31. An image forming process according to claim 19, wherein the developer stirring time when one A4 copy is made from one original is 4 seconds or more.

32. An image forming process according to claim 19, wherein the reflecting photosensor is a remote type, and the distance between the sensor and the photoconductor surface is 15 mm to 25 mm.

33. An image forming process according to claim 19, further comprising the step of controlling the supplementary amount of developer in the developing step based on the detection result of the developer amount detection step.

34. An image forming process according to claim 19, further comprising the step of recovering the toner removed from the photoconductor surface by the cleaning step, and feeds it back to the developing step.

* * * * *